US008863906B2

(12) United States Patent
Mustalahti et al.

(10) Patent No.: US 8,863,906 B2
(45) Date of Patent: Oct. 21, 2014

(54) ELEVATOR AND TRACTION SHEAVE OF AN ELEVATOR

(75) Inventors: Jorma Mustalahti, Hyvinkaa (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 467 days.

(21) Appl. No.: 10/419,890

(22) Filed: Apr. 22, 2003

(65) Prior Publication Data

US 2003/0183458 A1 Oct. 2, 2003

Related U.S. Application Data

(63) Continuation of application No. PCT/FI01/01071, filed on Dec. 7, 2001.

(30) Foreign Application Priority Data

Dec. 8, 2000 (FI) ..... 20002700

(51) Int. Cl.
*B66B 11/08* (2006.01)

(52) U.S. Cl.
USPC ..... 187/254; 187/251; 187/264; 187/266; 254/390; 254/393; 254/902; 474/166; 474/168; 474/177; 474/178

(58) Field of Classification Search
USPC ..... 187/251, 254, 264, 266; 254/290, 393, 254/902, 390; 474/166, 168, 177, 178
See application file for complete search history.

(56) References Cited

U.S. PATENT DOCUMENTS

| | | | | | |
|---|---|---|---|---|---|
| 1,944,426 | A | * | 1/1934 | Greening | 474/178 |
| 2,017,149 | A | * | 10/1935 | Greening | 474/170 |
| 2,806,380 | A | * | 9/1957 | Martin | 254/390 |
| 3,279,762 | A | * | 10/1966 | Bruns | 254/266 |
| 3,924,482 | A | * | 12/1975 | Meadows | 474/265 |
| 4,013,142 | A | * | 3/1977 | Hagg | 187/254 |
| 4,030,569 | A | * | 6/1977 | Berkovitz | 187/254 |
| 4,198,196 | A | | 4/1980 | Cilderman et al. | |
| 4,230,306 | A | * | 10/1980 | Porter | 254/371 |

(Continued)

FOREIGN PATENT DOCUMENTS

| | | | |
|---|---|---|---|
| CH | 641254 A5 | * | 5/1979 |
| EP | GB 2127934 | | 4/1984 |

(Continued)

OTHER PUBLICATIONS

Akio; "Driving Sheave"; Patent Abstracts of Japan; JP 57114061; Jul. 15, 1982.

(Continued)

*Primary Examiner* — Rakesh Kumar
(74) *Attorney, Agent, or Firm* — Harness, Dickey & Pierce PLC

(57) ABSTRACT

A counterweight and an elevator car are suspended on a set of hoisting ropes. The elevator comprises one or more rope pulleys provided with rope grooves, one of said pulleys being a traction sheave driven by a drive machine and moving the set of hoisting ropes. At least one of the rope pulleys has against the hoisting rope a coating adhesively bonded to the rope pulley and containing the rope grooves, said coating having an elasticity that is greater in the edge portions of the rope groove than at the bottom of the rope groove. In a preferred solution, the traction sheave is a rope pulley like this.

33 Claims, 6 Drawing Sheets

(56) References Cited

U.S. PATENT DOCUMENTS

| | | | | | |
|---|---|---|---|---|---|
| 4,402,488 | A * | 9/1983 | Berkovitz | 254/371 |
| 4,441,692 | A * | 4/1984 | Kovaleski | 254/390 |
| 4,624,097 | A * | 11/1986 | Wilcox | 57/232 |
| 4,756,388 | A | 7/1988 | Heikkinen | |
| 5,025,893 | A * | 6/1991 | Saito | 187/266 |
| 5,112,933 | A * | 5/1992 | O'Donnell et al. | 528/61 |
| 5,792,294 | A * | 8/1998 | Randazzo et al. | 156/94 |
| 6,401,871 | B2 * | 6/2002 | Baranda et al. | 187/254 |
| 6,419,208 | B1 * | 7/2002 | Baranda et al. | 254/390 |
| 6,488,124 | B1 | 12/2002 | Yasuda et al. | |
| 2004/0129501 | A1 | 7/2004 | Wittur et al. | |

FOREIGN PATENT DOCUMENTS

| | | | | |
|---|---|---|---|---|
| EP | 0194948 | | 9/1986 | |
| EP | 0194948 | A1 * | 9/1986 | |
| JP | 54-104145 | A * | 8/1979 | 187/254 |
| JP | 55-89181 | | 7/1980 | |
| JP | 5589181 | | 7/1980 | |
| JP | 57114061 | A * | 7/1982 | |
| JP | 57-203681 | | 12/1982 | |
| JP | 58074951 | | 6/1983 | |
| JP | 59-004588 | | 1/1984 | |
| JP | 59164450 | | 9/1984 | |
| JP | 64-007955 | | 2/1989 | |
| JP | 01-021075 | | 4/1989 | |
| JP | 01-030758 | | 6/1989 | |
| JP | 03-043196 | B2 | 7/1991 | |
| JP | 05-171580 | A | 7/1993 | |
| JP | 07-061744 | A | 3/1995 | |
| JP | 11-157762 | A | 6/1999 | |
| JP | 2000-095461 | A | 4/2000 | |
| JP | 2004-520245 | A | 7/2004 | |
| SU | 1641759 | A * | 4/1991 | 187/251 |

OTHER PUBLICATIONS

Janovsky; "Elevator Mechanical Design"; ISBN: 0-7458-0135-8; 1987; pp. 56-59.

European Patent Office Action dated Nov. 14, 2005 for corresponding European Patent Application No. 01 999 216.3-1022.

Japanese Patent Office Submission of Publications (filed by an anonymous third party) against Japanese Patent Application No. 2003-557938, dated Jan. 8, 2008.

"Safety rules for the construction and installation of lifts", The European Standard, BS EN 81-1:1998, pp. 1-7.

"Qualified Lift Examiner Training Textbook", Japan Building Equipment and Elevator Center Foundation, 2000, pp. 249, 255, 256, 327 (with partial English translation).

"Lift Glossary", The Japan Elevator Safety Centre Foundation, Oct. 1998, pp. 103, 172 (with partial English translation).

Office Action dated Nov. 10, 2009, issued in corresponding Korean Application No. 10-2009-7016053 and English-language translation of the Office Action.

* cited by examiner

ELEVATOR AND TRACTION SHEAVE OF AN ELEVATOR

This application is a continuation application under 37 C.F.R. §1.53(b) of PCT International Application No. PCT/FI01/01071 filed on Dec. 7, 2001, which claims the benefit under 35 U.S.C. §119(a) of Finnish Patent Application 20002700 filed Dec. 8, 2000, the entire contents of each of which are hereby incorporated by reference.

BACKGROUND

1. Field

The present invention relates to elevators and elevator traction sheaves as discussed below.

2. Description of Related Art

The operation of a conventional traction sheave elevator is based on a solution in which steel wire ropes serving as hoisting ropes and also as suspension ropes are moved by means of a metallic traction sheave, often made of cast iron, driven by an elevator drive machine. The motion of the hoisting ropes produces a motion of a counterweight and elevator car suspended on them. The tractive force from the traction sheave to the hoisting ropes, as well as the braking force applied by means of the traction sheave, is transmitted by the agency of the friction between the traction sheave and the ropes.

The coefficient of friction between the steel wire ropes and the metallic traction sheaves used in elevators is often insufficient in itself to maintain the required grip between the traction sheave and the hoisting rope in normal situations during elevator operation. The friction and the forces transmitted by the rope are increased by modifying the shape of the rope grooves on the traction sheave. The traction sheaves are provided with undercut or V-shaped rope grooves, which create a strain on the hoisting ropes and therefore also cause more wear of the hoisting ropes than rope grooves of an advantageous semicircular cross-sectional form as used e.g. in diverting pulleys. The force transmitted by the rope can also be increased by increasing the angle of bite between the traction sheave and the ropes, e.g. by using a so-called "double wrap" arrangement.

In the case of a steel wire rope and a cast-iron or cast-steel traction sheave, a lubricant is almost always used in the rope to reduce rope wear. A lubricant especially reduces the internal rope wear resulting from the interaction between rope strands. External wear of the rope consists of the wear of surface wires mainly caused by the traction sheave. The effect of the lubricant is also significant in the contact between the rope surface and the traction sheave.

To provide a substitute for the rope groove shape that causes rope wear, inserts placed in the rope groove to achieve a greater friction coefficient have been used. Such prior-art inserts are disclosed e.g. in specifications U.S. Pat. No. 3,279,762 and U.S. Pat. No. 4,198,196. The inserts described in these specifications are relatively thick. The rope grooves of the inserts are provided with a transverse or nearly transverse corrugation creating additional elasticity in the surface portion of the insert and in a way softening its surface. The inserts undergo wear caused by the forces imposed on them by the ropes, so they have to be replaced at intervals. Wear of the inserts occurs in the rope grooves, at the interface between insert and traction sheave and internally.

SUMMARY

It is an object of the invention to achieve an elevator in which the traction sheave has an excellent grip on a steel wire rope and in which the traction sheave is durable and of a design that reduces rope wear. Another object of the invention is to eliminate or avoid the above-mentioned disadvantages of prior-art solutions and to achieve a traction sheave that provides an excellent grip on the rope and is durable and reduces rope wear. A specific object of the invention is to disclose a new type of engagement between the traction sheave and the rope in an elevator. It is also an object of the invention to apply said engagement between the traction sheave and the rope to possible diverting pulleys of the elevator.

As for the features characteristic of the invention, reference is made to the claims.

In an elevator provided with hoisting ropes of substantially round cross-section, the direction of deflection of the hoisting ropes can be freely changed by means of a rope pulley. Thus, the basic layout of the elevator, i.e. the disposition of the car, counterweight and hoisting machine can be varied relatively freely. Steel wire ropes or ropes provided with a load-bearing part twisted from steel wires constitute a tried way of composing a set of hoisting ropes for suspending the elevator car and counterweight. An elevator driven by means of a traction sheave may comprise other diverting pulleys besides the traction sheave. Diverting pulleys are used for two different purposes: diverting pulleys are used to establish a desired suspension ratio of the elevator car and/or counterweight, and diverting pulleys are used to guide the passage of the ropes. Each diverting pulley may be mainly used for one of these purposes, or it may have a definite function both regarding the suspension ratio and as a means of guiding the ropes. The traction sheave driven by the drive machine additionally moves the set of hoisting ropes. The traction sheave and other eventual diverting pulleys are provided with rope grooves, each rope in the set of hoisting ropes being thus guided separately.

When a rope pulley has against a steel wire rope a coating containing rope grooves and giving great friction, a practically non-slip contact between rope pulley and rope is achieved. This is advantageous especially in the case of a rope pulley used as a traction sheave. If the coating is relatively thin, the force difference arising from the differences between the rope forces acting on different sides of the rope pulley will not produce a large tangential displacement of the surface that would lead to a large extension or compression in the direction of the tractive force when the rope is coming onto the pulley or leaving it. The greatest difference across the pulley occurs at the traction sheave, which is due to the usual difference of weight between the counterweight and the elevator car and to the fact that the traction sheave is not a freely rotating pulley but produces, at least during acceleration and braking, a factor either adding to or detracting from the rope forces resulting from the balance difference, depending on the direction of the balance difference and that of the elevator motion. A thin coating is also advantageous in that, as it is squeezed between the rope and the traction sheave, the coating can not be compressed so much that the compression would tend to evolve to the sides of the rope groove. As such compression causes lateral spreading of the material, the coating might be damaged by the great tensions produced in it. By making the coating thicker in the bottom area of the groove than in its lateral parts, a groove bottom portion having a greater elasticity than the edges is achieved. In this way, the surface pressure imposed on the rope can be more evenly distributed over the rope surface and the surface of the rope groove. Thus, the rope groove also provides more uniform support to the rope, and the pressure imposed on the rope maintains the cross-sectional form of the rope better. However, the coating must have a thickness sufficient to receive the rope elongations resulting from tension so that no rope slip fraying the coating occurs. At the same time, the coating has to be soft enough to allow the structural roughness of the rope, in other words, the surface wires to sink at least partially into the coating, yet hard enough to ensure that the coating will not substantially escape from under the roughness of the rope.

For steel wire ropes less than 10 mm thick, in which the surface wires are of a relatively small thickness, a coating hardness ranging from below 60 shoreA up to about 100 shoreA can be used. For ropes having surface wires thinner than in conventional elevator ropes, i.e. ropes having surface wires only about 0.2 mm thick, a preferable coating hardness is in the range of about 80 . . . 90 shoreA or even harder. A relatively hard coating can be made thin. When a rope with somewhat thicker surface wires (about 0.5 . . . 1 mm) is used, a good coating hardness is in the range of about 70 . . . 85 shoreA and a thicker coating is needed. In other words, for thinner wires a harder and thinner coating is used, and for thicker wires a softer and thicker coating is used. As the coating is firmly attached to the sheave by an adhesive bond comprising the entire area resting against the sheave, there will occur between the coating and the sheave no slippage causing wear of these. An adhesive bond may be made e.g. by vulcanizing a rubber coating onto the surface of a metallic rope sheave or by casting polyurethane or similar coating material onto a rope sheave with or without an adhesive or by applying a coating material on the rope sheave or gluing a coating element fast onto the rope sheave.

Thus, on the one hand, due to the total load or average surface pressure imposed on the coating by the rope, the coating should be hard and thin, and on the other hand, the coating should be sufficiently soft and thick to permit the rough surface structure of the rope to sink into the coating to a suitable degree to produce sufficient friction between the rope and the coating and to ensure that the rough surface structure will not pierce the coating.

A highly advantageous embodiment of the invention is the use of a coating on the traction sheave. Thus, a preferred solution is to produce an elevator in which at least the traction sheave is provided with a coating. A coating is also advantageously used on the diverting pulleys of the elevator. The coating functions as a damping layer between the metallic rope pulley and the hoisting ropes.

The coating of the traction sheave and that of a rope pulley may be differently rated so that the coating on the traction sheave is designed to accommodate a larger force difference across the sheave. The properties to be rated are thickness and material properties of the coating. Preferable coating materials are rubber and polyurethane. The coating is required to be elastic and durable, so it is possible to use other durable and elastic materials as far as they can be made strong enough to bear the surface pressure produced by the rope. The coating may be provided with reinforcements, e.g. carbon fiber or ceramic or metallic fillers, to improve its capacity to withstand internal tensions and/or the wearing or other properties of the coating surface facing the rope.

The invention provides the following advantages, among other things:

- great friction between traction sheave and hoisting rope
- a coating having a greater thickness in the bottom area of the groove distributes the load evenly in the transverse direction of the rope groove, so the groove bottom is not subjected to a greater strain than the edge portions
- uniform support of the rope reduces the strain on the internal portions of the rope
- the coating reduces abrasive wear of the ropes, which means that less wear allowance is needed in the surface wires of the rope, so the ropes can be made entirely of thin wires of strong material
- since the ropes can be made of thin wires, and since thin wires can be made relatively stronger, the hoisting ropes may be correspondingly thinner, smaller rope pulleys can be used, which again allows a space saving and more economical layout solutions
- the coating is durable because in a relatively thin coating no major internal expansion occurs
- in a thin coating, deformations are small and therefore also the dissipation resulting from deformations and producing heat internally in the coating is low and heat is easily removed from the thin coating, so the thermal strain produced in the coating by the load is small
- as the rope is thin and the coating on the rope pulley is thin and hard, the rope pulley rolls lightly against the rope
- no wear of the coating occurs at the interface between the metallic part of the traction sheave and the coating material
- the great friction between the traction sheave and the hoisting rope allows the elevator car and counterweight to be made relatively light, which means a cost saving.

BRIEF DESCRIPTION OF THE DRAWINGS

In the following, the invention will be described in detail with reference to the attached drawings, wherein.

DETAILED DESCRIPTION OF EXAMPLE EMBODIMENTS

Figure 1:
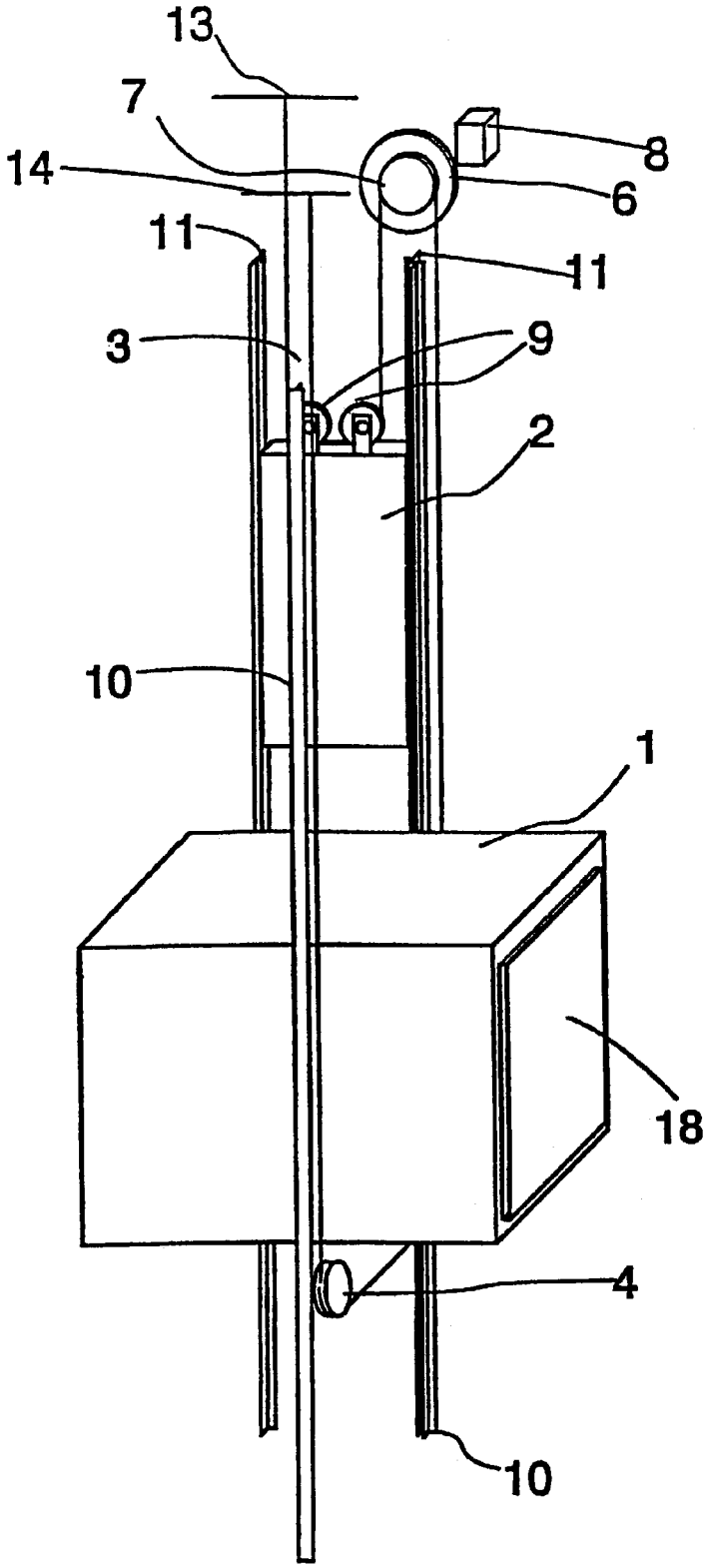
FIG. 1 illustrates a diagram representing an elevator according to an example embodiment of the present invention.

FIG. 1 is a diagrammatic representation of the structure of an elevator. The elevator is preferably an elevator without machine room, in which the drive machine 6 is placed in the elevator shaft, although the invention is also applicable for use in elevators with machine room. The passage of the hoisting ropes 3 of the elevator is as follows: One end of the ropes is immovably fixed to an anchorage 13 located in the upper part of the shaft above the path of a counterweight 2 moving along counterweight guide rails 11. From the anchorage, the ropes run downward and are passed around diverting pulleys 9 suspending the counterweight, which diverting pulleys 9 are rotatably mounted on the counterweight 2 and from which the ropes 3 run further upward to the traction sheave 7 of the drive machine 6, passing around the traction sheave along rope grooves on the sheave. From the traction sheave 7, the ropes 3 run further downward to the elevator car 1 moving along car guide rails 10, passing under the car via diverting pulleys 4 used to suspend the elevator car on the ropes, and going then upward again from the elevator car to an anchorage 14 in the upper part of the elevator shaft, to which anchorage the second end of the ropes 3 is fixed. Anchorage 13 in the upper part of the shaft, the traction sheave 7 and the diverting pulley 9 suspending the counterweight on the ropes are preferably so disposed in relation to each other that both the rope portion going from the anchorage 13 to the counterweight 2 and the rope portion going from the counterweight 2 to the traction sheave 7 are substantially parallel to the path of the counterweight 2. Similarly, a solution is preferred in which anchorage 14 in the upper part of the shaft, the traction sheave 7 and the diverting pulleys 4 suspending the elevator car on the ropes are so disposed in relation to each other that the rope portion going from the anchorage 14 to the elevator car 1 and the rope portion going from the elevator car 1 to the traction sheave 7 are substantially parallel to the path of the elevator car 1. With this arrangement, no additional diverting pulleys are needed to define the passage of the ropes in the shaft. The rope suspension acts in a substantially centric manner on the elevator car 1, provided that the rope pulleys 4 supporting the elevator car are mounted substantially symmetrically relative to the vertical center line passing via the center of gravity of the elevator car 1.

The drive machine 6 placed in the elevator shaft is preferably of a flat construction, in other words, the machine has a small depth as compared with its width and/or height, or at least the machine is slim enough to be accommodated between the elevator car and a wall of the elevator shaft. The machine may also be placed differently. Especially a slim machine can be fairly easily fitted above the elevator car. The elevator shaft can be provided with equipment required for the supply of power to the motor driving the traction sheave 7 as well as equipment for elevator control, both of which can be placed in a common instrument panel 8 or mounted separately from each other or integrated partly or wholly with the drive machine 6. The drive machine may be of a geared or gearless type. A preferable solution is a gearless machine comprising a permanent magnet motor. The drive machine may be fixed to a wall of the elevator shaft, to the ceiling, to a guide rail or guide rails or to some other structure, such as a beam or frame. In the case of an elevator with machine below, a further possibility is to mount the machine on the bottom of the elevator shaft. FIG. 1 illustrates the economical 2:1 suspension, but the invention can also be implemented in an elevator using a 1:1 suspension ratio, in other words, in an elevator in which the hoisting ropes are connected directly to the counterweight and elevator car without diverting pulleys, or in an elevator implemented using some other suspension arrangement suited for a traction sheave elevator.

Figure 2:
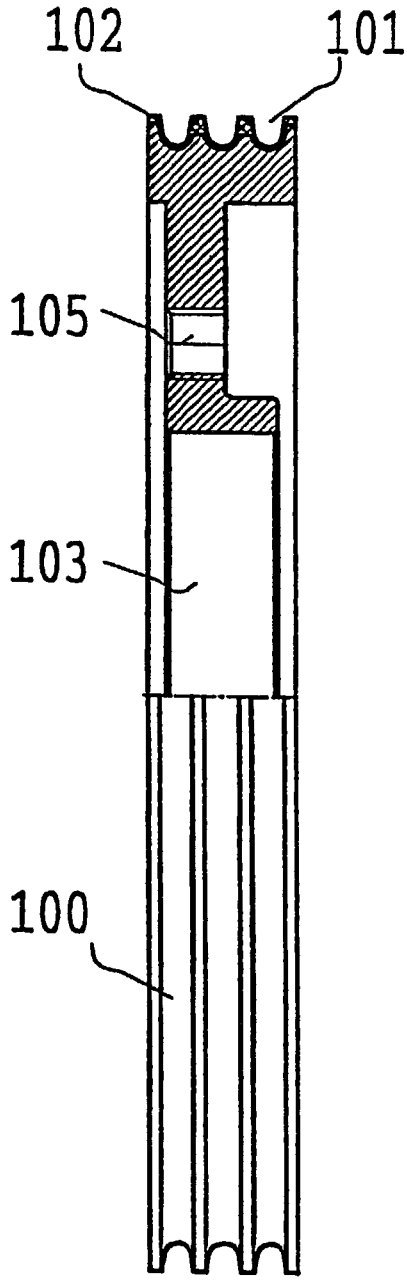
FIG. 2 illustrates a rope pulley according to an example embodiment of the present invention.

FIG. 2 presents a partially sectioned view of a rope pulley 100 applying the invention. The rope grooves 101 are in a coating 102 placed on the rim of the rope pulley 100. The rope pulley 100 is preferably made of metal or plastic. Provided in the hub of the rope pulley 100 is a space 103 for a bearing used to support the rope pulley 100. The rope pulley 100 is also provided with holes 105 for bolts, allowing the rope pulley 100 to be fastened by its side to an anchorage in the drive machine 6, e.g., to a rotating flange, to form a traction sheave 7, in which case no bearing separate from the drive machine 6 is needed.

Figure 3:
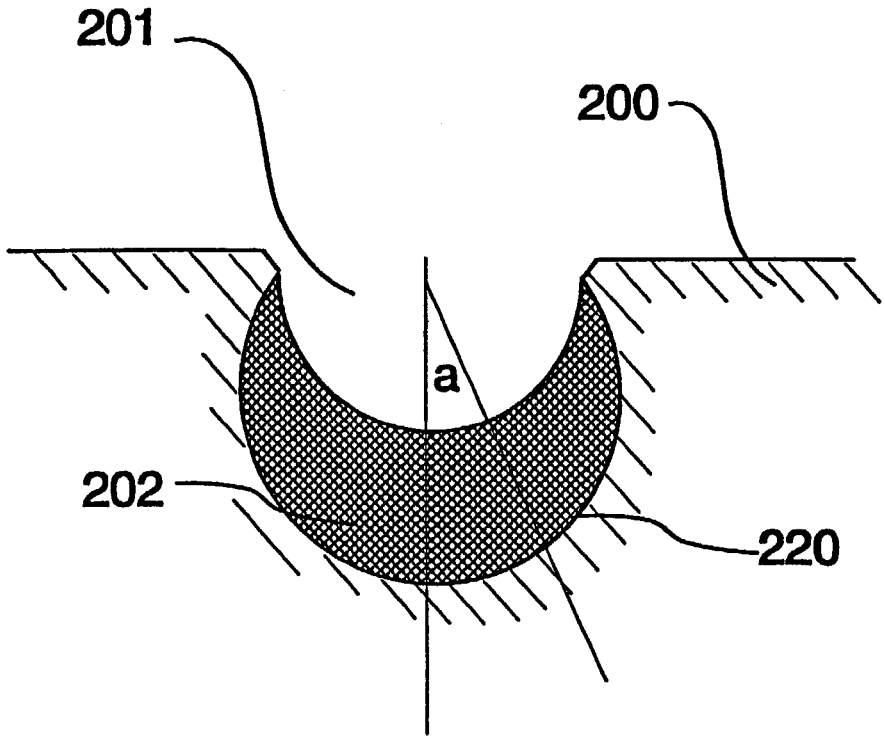
FIG. 3 illustrates a coating solution according to an example embodiment of the present invention.

FIG. 3 presents a solution in which the rope groove 201 is in a coating 202 which is thinner at the sides of the rope groove than at the bottom. In such a solution, the coating is placed in a basic groove 220 provided in the rope pulley 200 so that deformations produced in the coating by the pressure imposed on it by the rope will be small and mainly limited to the rope surface texture sinking into the coating. Such a solution often means in practice that the rope pulley coating consists of rope groove-specific sub-coatings separate from each other, but the inventive idea does not exclude an alternative in which the rope pulley coating extends continuously over a number of grooves.

Figure 4:
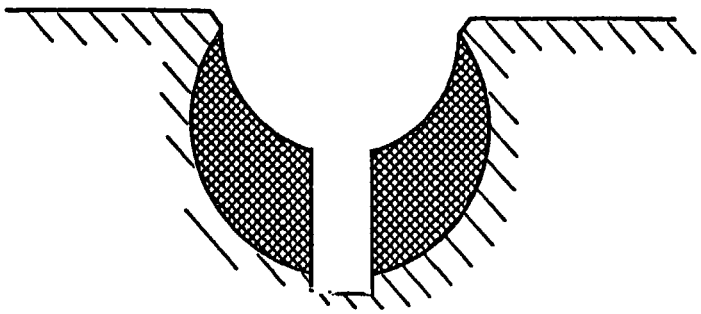
FIGS. 4 and 5 illustrate alternative coating solutions according to an example embodiment of the present invention.
Figure 5:
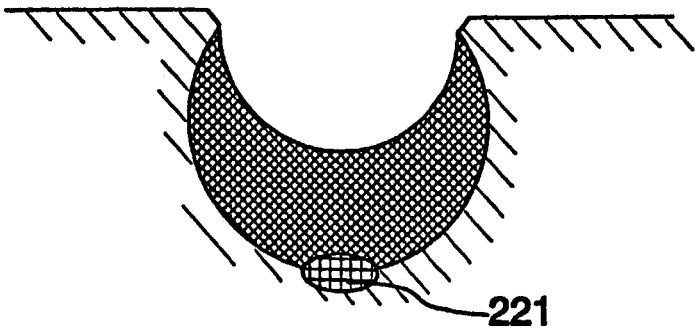
Figure 6:
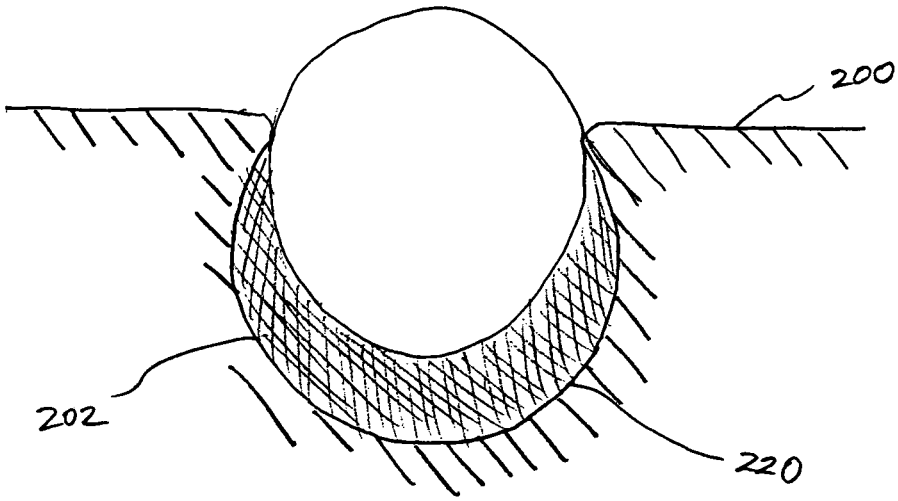
FIG. 6 illustrates a hoisting rope in a rope groove according to an example embodiment of the present invention.

By making the coating thinner at the edges of the groove than at its bottom, the strain imposed by the rope on the bottom of the rope groove while sinking into the groove is avoided or at least reduced. As the pressure cannot be discharged laterally but is directed by the combined effect of the shape of the basic groove 220 and the thickness variation of the coating 202 to support the rope in the rope groove 201, lower maximum surface pressures acting on the rope and the coating are also achieved. One method of making a grooved coating 202 like this is to fill the round-bottomed basic groove 220 with coating material and then form a half-round rope groove 201 in this coating material in the basic groove. The shape of the rope grooves is well supported and the load-bearing surface layer under the rope provides a better resistance against lateral propagation of the compression stress produced by the ropes. The lateral spreading or rather adjustment of the coating caused by the pressure is promoted by thickness and elasticity of the coating and reduced by hardness and eventual reinforcements of the coating. The coating thickness on the bottom of the rope groove can be made large, even as large as half the rope thickness, in which case a hard and inelastic coating is needed. On the other hand, if a coating thickness corresponding to only about one tenth of the rope thickness is used, then the coating material may be clearly softer. An elevator for eight persons could be implemented using a coating thickness at the bottom of the groove equal to about one fifth of the rope thickness if the ropes and the rope load are chosen appropriately. The coating thickness should equal at least 2-3 times the depth of the rope surface texture formed by the surface wires of the rope. Such a very thin coating, having a thickness even less than the thickness of the surface wire of the rope, will not necessarily endure the strain imposed on it. In practice, the coating must have a thickness larger than this minimum thickness because the coating will also have to receive rope surface variations rougher than the surface texture. Such a rougher area is formed e.g. where the level differences between rope strands are larger than those between wires. In practice, a suitable minimum coating thickness is about 1-3 times the surface wire thickness. In the case of the ropes normally used in elevators, which have been designed for a contact with a metallic rope groove and which have a thickness of 8-10 mm, this thickness definition leads to a coating at least about 1 mm thick. Since a coating on the traction sheave, which causes more rope wear than the other rope pulleys of the elevator, will reduce rope wear and therefore also the need to provide the rope with thick surface wires, the rope can be made smoother. The use of thin wires allows the rope itself to be made thinner, because thin steel wires can be manufactured from a stronger material than thicker wires. For instance, using 0.2 mm wires, a 4 mm thick elevator hoisting rope of a fairly good construction can be produced. A traction sheave coating well suited for such a rope is already clearly below 1 mm thick. However, the coating should be thick enough to ensure that it will not be very easily scratched away or pierced e.g. by an occasional sand grain or similar particle having got between the rope groove and the hoisting rope. Thus, a desirable minimum coating thickness, even when thin-wire hoisting ropes are used, would be about 0.5 . . . 1 mm. For hoisting ropes having small surface wires and an otherwise relatively smooth surface, a coating having a thickness of the form A+B cos a is well suited. However, such a coating is also applicable to ropes whose surface strands meet the rope groove at a distance from each other, because if the coating material is sufficiently hard, each strand meeting the rope groove is in a way separately supported and the supporting force is the same and/or as desired. In the formula A+B cos a, A and B are constants so that A+B is the coating thickness at the bottom of the rope groove 201 and the angle a is the angular distance from the bottom of the rope groove as measured from the center of curvature of the rope groove cross-section. Constant A is larger than or equal to zero, and constant B is always larger than zero. The thickness of the coating growing thinner towards the edges can also be defined in other ways besides using the formula A+B cos a so that the elasticity decreases towards the edges of the rope groove. FIGS. 4 and 5 present cross-sectional views of rope grooves in which the elasticity of the middle portion of the rope groove has been specially increased. The rope groove in FIG. 4 is an undercut groove. In FIG. 5, the coating on the bottom of the rope groove comprises a particularly elastic area 221 of a different material, where the elasticity has been increased, in addition to increasing the material thickness, by the use of a material that is softer than the rest of the coating.

Figure 7A:
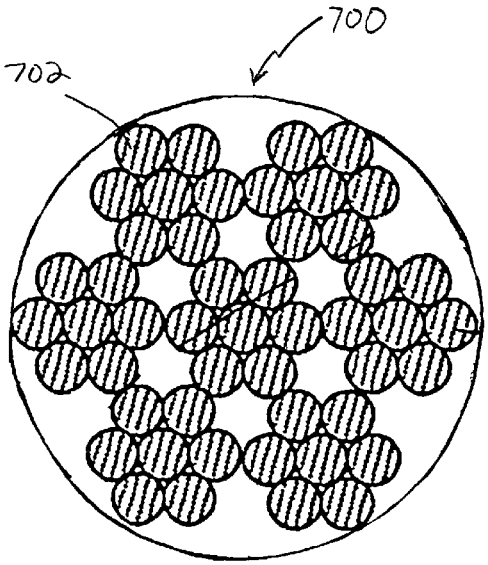
FIGS. 7*a*, 7*b*, and 7*c* illustrate steel wire ropes according to example embodiments of the present invention.
Figure 7B:
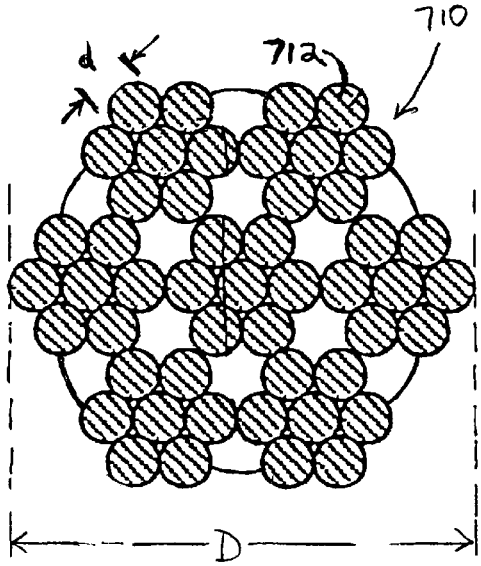
Figure 7C:
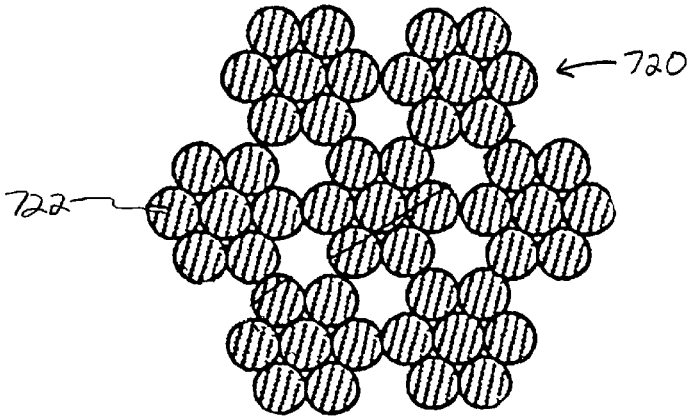

FIGS. 7*a*, 7*b*, and 7*c* illustrate steel wire ropes according to example embodiments of the present invention. As shown in FIG. 7*a*, steel wire rope 700 may include surface wires 702. As shown in FIG. 7*b*, steel wire rope 710 may include surface wires 712. As also shown in FIG. 7*b*, steel wire rope 710 may have a diameter D. Diameter D may be, for example, less than or equal to 10 mm. Additionally, as shown in FIG. 7*b*, surface wires 712 may have a diameter d. Diameter d may be, for example, less than about 1 mm. As shown in FIG. 7*c*, steel wire rope 720 may include surface wires 722.

In the foregoing, the invention has been described by way of example with reference to the attached drawing while different embodiments of the invention are possible within the scope of the inventive idea defined in the claims. In the scope of the inventive idea, it is obvious that a thin rope increases the average surface pressure imposed on the rope groove if the rope tension remains unchanged. This can be easily taken into account by adapting the thickness and hardness of the coating, because a thin rope has thin surface wires, so for instance the use of a harder and/or thinner coating will not cause any problems. It is also obvious to a skilled person that the bearing surface of a rope groove of semi-circular cross-section may be less than 180 degrees.

The invention claimed is:

1. An elevator, comprising:
an elevator car;
a counterweight;
a set of hoisting ropes, the elevator car and counterweight suspended on the set of hoisting ropes; and
one or more rope pulleys provided with one or more rope grooves adapted to receive at least one hoisting rope of the set of hoisting ropes;
wherein at least one of the one or more rope grooves includes:
a basic groove;
a coating adhesively bonded to the basic groove; and
an elastic area near a bottom of the basic groove;
wherein the at least one of the one or more ropes grooves generally conforms to a semicircular shape,
wherein the at least one of the one or more ropes grooves includes:
a top surface adapted to receive one of the set of hoisting ropes;
a substantially semicircular bottom surface; and
groove sides;
wherein the elastic area includes different material than the coating,
wherein a thickness of the coating at a bottom of the at least one of the one or more rope grooves is substantially less than half of a thickness of the one of the set of hoisting ropes running in the at least one of the one or more rope grooves,
wherein an elasticity of the coating at the groove sides of the at least one of the one or more rope grooves is less than the elasticity of the coating at a bottom of the at least one of the one or more rope grooves,
wherein the set of hoisting ropes includes steel wire ropes,
wherein the steel wire ropes have a diameter less than or equal to 10 mm,
wherein surface wires of the steel wire ropes have a diameter less than about 1 mm, and
wherein a combined minimum thickness of the coating and elastic area, at a bottom of the at least one of the one or more rope grooves, is about 0.5 mm.

2. The elevator of claim 1, further comprising:
a drive machine;
wherein one of the one or more rope pulleys is a traction sheave driven by the drive machine for moving the set of hoisting ropes, and
wherein the traction sheave includes a coating on the traction sheave.

3. The elevator of claim 1, wherein all of the rope pulleys include coatings on the rope pulleys.

4. The elevator of claim 1, wherein the coating is thinner at the groove sides of the at least one of the one or more rope grooves than at the bottom of the at least one of the one or more rope grooves.

5. The elevator of claim 1, wherein the coating has a Shore A hardness greater than or equal to about 60 and less than or equal to about 100.

6. The elevator of claim 1, wherein the at least one hoisting rope has a substantially round cross-section.

7. The elevator of claim 1, further comprising:
a traction sheave; and
a coating adhesively bonded to the traction sheave;
wherein the thickness of the coating is defined by A+B cos a,
wherein A and B are constants, and
wherein 'a' is an angular distance from the bottom of the rope groove.

8. The elevator of claim 1, wherein the coating contacts with the one of the set of hoisting ropes running in the at least one of the one or more rope grooves.

9. The elevator of claim 1, wherein a thinning of the coating thickness toward sides of the at least one of the one or more rope grooves facilitates a decreasing elasticity toward the groove sides.

10. The elevator of claim 1, wherein lateral spreading of the coating caused by compression stress produced by the one of the set of hoisting ropes in the at least one of the one or more rope grooves is promoted by different elasticity of the coating at the groove sides and at the bottom of the at least one of the one or more rope grooves.

11. A coating adhesively bonded to a basic groove within a traction sheave of an elevator, the coating and the basic groove forming a rope groove, the coating comprising:
a semicircular top surface that forms a surface adapted to receive at least one hoisting rope; and
a substantially semicircular bottom surface that contacts a bottom of the basic groove to form a substantially semicircular bottom of the rope groove;
wherein the rope groove includes groove sides,
wherein the rope groove further includes an elastic area near the bottom of the rope groove, wherein the elastic area includes different material than the coating, wherein the coating is thickest at the bottom of the rope groove, wherein a thickness of the coating diminishes gradually at ends of the groove sides, wherein the thickness of the coating at the bottom of the rope groove is substantially less than half a thickness of the at least one hoisting rope in the rope groove, wherein the at least one hoisting rope includes at least one steel wire rope, wherein the at least one steel wire rope has a diameter less than or equal to 10 mm, wherein surface wires of the at least one steel wire rope have a diameter less than about 1 mm, and wherein a combined minimum thickness of the coating and elastic area, at a bottom of the rope groove, is about 0.5 mm.

12. A traction sheave of an elevator, the traction sheave designed for hoisting ropes of substantially round cross-section, the traction sheave comprising:

a coating adhesively bonded to the traction sheave;

wherein the coating has a semicircular top surface that forms a surface of a rope groove adapted to receive at least one hoisting rope, wherein the coating has a substantially semicircular bottom surface that forms a bottom of the rope groove, wherein the rope groove includes groove sides, wherein the rope groove further includes an elastic area near the bottom of the rope groove, wherein the elastic area includes different material than the coating, wherein a thickness of the coating at the bottom of the rope groove is substantially less than half a thickness of the at least one hoisting rope running in the rope groove, wherein an elasticity of the coating at the groove sides of the rope groove is less than the elasticity of the coating at the bottom of the rope groove, wherein the at least one hoisting rope includes at least one steel wire rope, wherein the at least one steel wire rope has a diameter less than or equal to 10 mm, wherein surface wires of the at least one steel wire rope have a diameter less than about 1 mm, and wherein a combined minimum thickness of the coating and elastic area, at a bottom of the rope groove, is about 0.5 mm.

13. The traction sheave of claim 12, wherein the coating has a Shore A hardness greater than or equal to about 60 and less than or equal to about 100.

14. The traction sheave of claim 13, wherein the thickness of the coating is defined by A+B cos a, wherein A and B are constants, and wherein 'a' is an angular distance from the bottom of the rope groove.

15. The traction sheave of claim 12, wherein the coating is made of rubber, polyurethane, or another elastic material.

16. The traction sheave of claim 15, wherein the thickness of the coating is defined by A+B cos a, wherein A and B are constants, and wherein 'a' is angular distance from the bottom of the rope groove.

17. The traction sheave of claim 12, wherein the coating is thinner at the groove sides of the rope groove than at the bottom of the rope groove.

18. The traction sheave of claim 17, wherein the thickness of the coating is defined by A+B cos a, wherein A and B are constants, and wherein 'a' is an angular distance from the bottom of the rope groove.

19. The traction sheave of claim 12, wherein the coating contacts the at least one hoisting rope running in the rope groove.

20. The traction sheave of claim 12, wherein the thickness of the coating is defined by A+B cos a, wherein A and B are constants, and wherein 'a' is an angular distance from the bottom of the rope groove.

21. The traction sheave of claim 12, wherein a thinning of the coating thickness toward the groove sides of the rope groove facilitates a decreasing elasticity toward the groove sides.

22. The traction sheave of claim 12, wherein lateral spreading of the coating caused by compression stress produced by the at least one hoisting rope in the rope groove is promoted by different elasticity of the coating at the groove sides and at the bottom of the rope groove.

23. A coating for at least one rope pulley that is configured to receive one or more hoisting ropes of an elevator, the at least one rope pulley including one or more basic grooves adapted to receive at least one of the one or more hoisting ropes, the coating provided within one of the one or more basic grooves to form a rope groove, the coating comprising:

a semicircular top surface adapted to receive the at least one of the one or more hoisting ropes; and a substantially semicircular bottom surface that contacts a bottom of the basic groove to form a substantially semicircular bottom of the rope groove;

wherein the rope groove includes groove sides, wherein the rope groove further includes an elastic area near the bottom of the basic groove, wherein the elastic area includes different material than the coating, wherein a thickness of the coating at the bottom of the rope groove is substantially less than half a thickness of the at least one of the one or more hoisting ropes in the rope groove, wherein an elasticity of the coating at the groove sides of the rope groove is less than the elasticity of the coating at the bottom of the rope groove, wherein the at least one of the one or more hoisting ropes includes at least one steel wire rope, wherein the at least one steel wire rope has a diameter less than or equal to 10 mm, wherein surface wires of the at least one steel wire rope have a diameter less than about 1 mm, and wherein a combined minimum thickness of the coating and elastic area, at a bottom of the rope groove, is about 0.5 mm.

24. The coating of claim 23, wherein the coating has a Shore A hardness greater than or equal to about 60 and less than or equal to about 100.

25. The coating of claim 23, wherein the at least one rope pulley is a traction sheave driven by a drive machine of the elevator for moving the one or more hoisting ropes.

26. The coating of claim 25, wherein the thickness of the coating is defined by A+B cos a, wherein A and B are constants, and wherein 'a' is an angular distance from the bottom of the rope groove.

27. The coating of claim 23, wherein the thickness of the coating varies in a widthwise direction of the rope groove on the at least one rope pulley so as to be thinner at the groove sides of the rope groove than at the bottom of the rope groove.

28. An elevator, comprising:

an elevator car;

a counterweight;

a set of hoisting ropes, the elevator car and counterweight suspended on the set of hoisting ropes; and one or more rope pulleys provided with one or more rope grooves adapted to receive a given hoisting rope in the one or more rope grooves;

wherein at least one of the one or more rope grooves includes a coating adhesively bonded to the at least one of the one or more rope grooves, wherein the coating has a semicircular-shaped top surface that substantially conforms to and envelops a lower half of the given hoisting rope within the at least one of the one or more rope grooves, so that an upper half of the given hoisting rope extends above a planar surface of a given rope pulley including the at least one of the one or more rope grooves, wherein the coating has a substantially semicircular bottom surface, wherein at least one of the one or more rope grooves includes sides that represent sides of the at least one of the one or more rope grooves with the coating, wherein the at least one of the one or more rope grooves further includes an elastic area near a bottom of the at least one of the one or more rope grooves, wherein the elastic area includes different material than the coating, wherein the set of hoisting ropes includes steel wire ropes, wherein the steel wire ropes have a diameter less than or equal to 10 mm, wherein surface wires of the steel wire ropes have a diameter less than about 1 mm, and wherein a combined minimum thickness of the coating and elastic area, at a bottom of the at least one of the one or more rope grooves, is about 0.5 mm.

29. The elevator of claim 28, wherein a shape of the coating provides support so that a load-bearing surface layer represented by the coating top surface under the given hoisting rope provides improved resistance against lateral propagation of compression stress produced by the given hoisting rope within the at least one of the one or more rope grooves.

30. A traction sheave of an elevator, the traction sheave designed for hoisting ropes of substantially round cross-section, the traction sheave comprising:

a coating adhesively bonded to the traction sheave as part of a rope groove in the traction sheave;

wherein the coating includes:

a semicircular-shaped top surface that is adapted to substantially conform to and envelop a lower half of a hoisting rope within the rope groove, so that an upper half of the hoisting rope extends above a planar surface of the traction sheave including the rope groove;

a substantially semicircular bottom surface; and sides that represent sides of the rope groove with the coating;

wherein the rope groove includes an elastic area near a bottom of the rope groove, wherein the elastic area includes different material than the coating, wherein the hoisting rope includes at least one steel wire rope, wherein the at least one steel wire rope has a diameter less than or equal to 10 mm, wherein surface wires of the at least one steel wire rope have a diameter less than about 1 mm, and wherein a combined minimum thickness of the coating and elastic area, at a bottom of the rope groove, is about 0.5 mm.

31. The traction sheave of claim 30, wherein a shape of the coating provides support so that a load-bearing surface layer represented by the coating top surface under the hoisting rope provides improved resistance against lateral propagation of compression stress produced by the hoisting rope within the rope groove.

32. A coating adhesively bonded to a basic groove within a traction sheave of an elevator, the coating and the basic groove forming a rope groove, the coating comprising:

a top surface adapted to receive at least one hoisting rope; groove sides; and a bottom surface that contacts a bottom of the basic groove to form a bottom of the rope groove;

wherein the top surface has a semicircular shape that substantially conforms to and envelops a lower half of the at least one hoisting rope within the rope groove, so that an upper half of the at least one hoisting rope extends above a planar surface of the traction sheave, wherein the rope groove includes an elastic area near the bottom of the basic groove, wherein the elastic area includes different material than the coating, wherein the at least one hoisting rope includes at least one steel wire rope, wherein the at least one steel wire rope has a diameter less than or equal to 10 mm, wherein surface wires of the at least one steel wire rope have a diameter less than about 1 mm, and wherein a combined minimum thickness of the coating and elastic area, at a bottom of the rope groove, is about 0.5 mm.

33. The coating of claim 32, wherein a shape of the coating provides support so that a load-bearing surface layer represented by the coating top surface under the at least one hoisting rope provides improved resistance against lateral propagation of compression stress produced by the at least one hoisting rope within the rope groove.

* * * * *